US006971648B2

(12) United States Patent
MacKinnon

(10) Patent No.: US 6,971,648 B2
(45) Date of Patent: Dec. 6, 2005

(54) GAME OF HAND-EYE SKILL

(76) Inventor: Jamie MacKinnon, 3829 Sunvalley Avenue, Sudbury, Ontario (CA) P3G 1K3

( * ) Notice: Subject to any disclaimer, the term of this patent is extended or adjusted under 35 U.S.C. 154(b) by 0 days.

(21) Appl. No.: 10/408,442

(22) Filed: Apr. 8, 2003

(65) Prior Publication Data

US 2004/0201173 A1 Oct. 14, 2004

(51) Int. Cl.[7] ..... A63F 9/00

(52) U.S. Cl. ..... 273/119 R; 273/118 R; 273/441

(58) Field of Search ..... 273/440, 441, 273/118 R, 108, 123 R, 129 R, 129 K, 459, 273/120 R, 119 R; 446/168

(56) References Cited

U.S. PATENT DOCUMENTS 2,597,671 A * 5/1952 Prentiss ..... 273/108
3,204,965 A * 9/1965 Engle ..... 273/119 R
3,612,531 A * 10/1971 Barlow ..... 273/369
3,704,889 A * 12/1972 Huffman et al. ..... 273/119 R
3,770,276 A * 11/1973 Breslow ..... 273/119 R
6,234,918 B1 * 5/2001 Nally et al. ..... 473/473
6,386,538 B1 * 5/2002 Mejia ..... 273/118 R
2004/0201173 A1 * 10/2004 MacKinnon ..... 273/441

* cited by examiner

*Primary Examiner*—Raleigh W. Chiu

(57) ABSTRACT

In a game requiring hand-eye coordination, the present invention comprises a game box, a liner tray with dividers forming cavities of various sized, an arch assembly having a tethered projectile, a curved rail portion, a target ball, a target-ball release, and a score-keeping. A player holds the suspended projectile, and then the target ball is released where it will sway back and forth atop the channel of the curved rail portion, using hand-eye skill the player attempts to strike the target ball with the suspended projectile in order to de-rail the target ball into the highest scoring cavity in the liner tray. Two players can each take turns and the player who reaches the highest score wins.

9 Claims, 3 Drawing Sheets

GAME OF HAND-EYE SKILL

FIELD OF THE INVENTION

The present invention relates to a game requiring hand-eye coordination having a game box, a liner tray with dividers, an arch assembly having a suspended projectile, a curved rail portion, a target-ball, a target-ball release means and score-keeping means. A player holds the suspended projectile, and then the target ball is released where it will sway back and forth atop the channel of the curved rail portion, using hand-eye skills the player attempts to strike the target ball with the suspended projectile in order to de-rail the target ball into the highest scoring cavity in the liner tray. Two players can each take turns and the player who reaches the highest score wins.

BACKGROUND OF THE INVENTION

Without knowledge of prior related art, the inventor of the present invention sought to create a game that posed a high level challenge to players where both the projectile and the target are in motion. Upon further thought, the conception of this present invention was made.

Upon completion of a working model, it became apparent that the present invention would gain the acceptance of the masses since it was unlike most table games.

The applicant is aware of attempts in prior art to provide games using suspended projectiles, namely in the context of bowling pins as a target.

An example may be had when referring to U.S. Pat. No. 2,319,917 of Bruneau, issued May 25, 1943 depicting a portable game using a tethered projectile for striking still miniature bowling pins. However, this invention fails to introduce a moving target.

Another example may be had in referring to U.S. Pat. No. 4,685,674 of Toth, issued Aug. 11, 1987, which teaches of a tethered ball game where a plurality of fixed target pins are aimed to topple over. The tether pivot point may be alternately located to increase the level of difficulty. However, this invention also fails to introduce a moving target.

SUMMARY OF THE INVENTION

It is thus the object of the present invention to provide players with a game of hand-eye skill where both the projectile and the target are in motion in order to increase the level of complexity and interest of play.

In one aspect of the invention, two or more tethered projectiles may be provide so as to allow both players to compete simultaneously for the strike of the moving target ball.

Accordingly, the game of the present invention provides players with a competitive hand-eye gaming challenge.

BRIEF DESCRIPTION OF THE DRAWINGS

These and other advantages of the invention will become apparent upon reading the following brief description and upon referring to the drawings in which.

Figure 1:
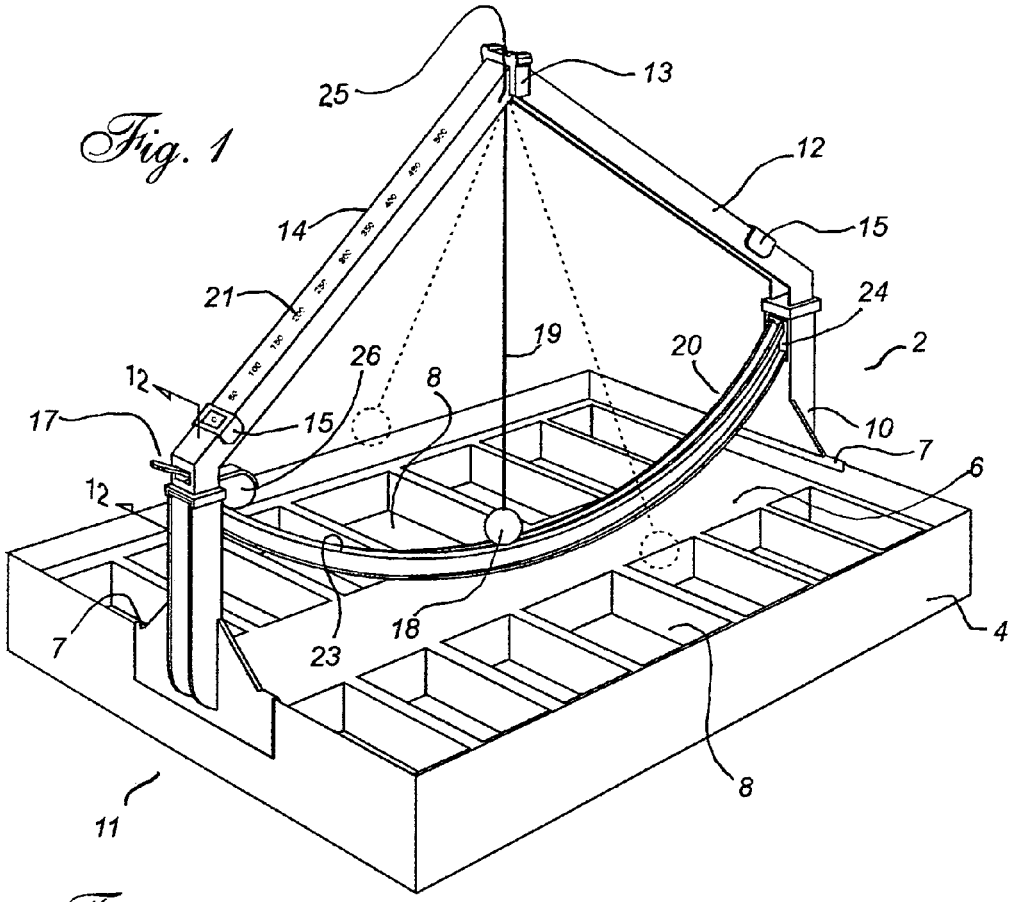
FIG. 1 is a perspective view of the game of hand-eye skill of the present invention.

While the invention is described in conjunction with preferred illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT

In the following description, similar features in the drawings have been given similar reference numerals.

Turning to the drawings, in particular, FIG. 1, which illustrates a perspective view of the whole game of the present invention comprising: a game box 4 having a generally rectangular plan, raised edges around its periphery, a liner tray 6 fitted to the inside of the game box 4, having a plurality of downwardly protruding cavities 8 & 8*a–c* of various sizes located along both long edged of said tray 6, an arch assembly having two game box attaching portions 10 & 11, two upwardly and inwardly projecting arch members 12 & 14 and scoring means 15 frictionally and slidably engaged to the upper portions of each arch members 12 & 14, a free-ball curved rail member 20 releasably and firmly attached to both game attaching portions 10 & 11, an arch-connecting clip 13, a tethered projectile 18, and a free-ball releasing means 17.

Figure 2:
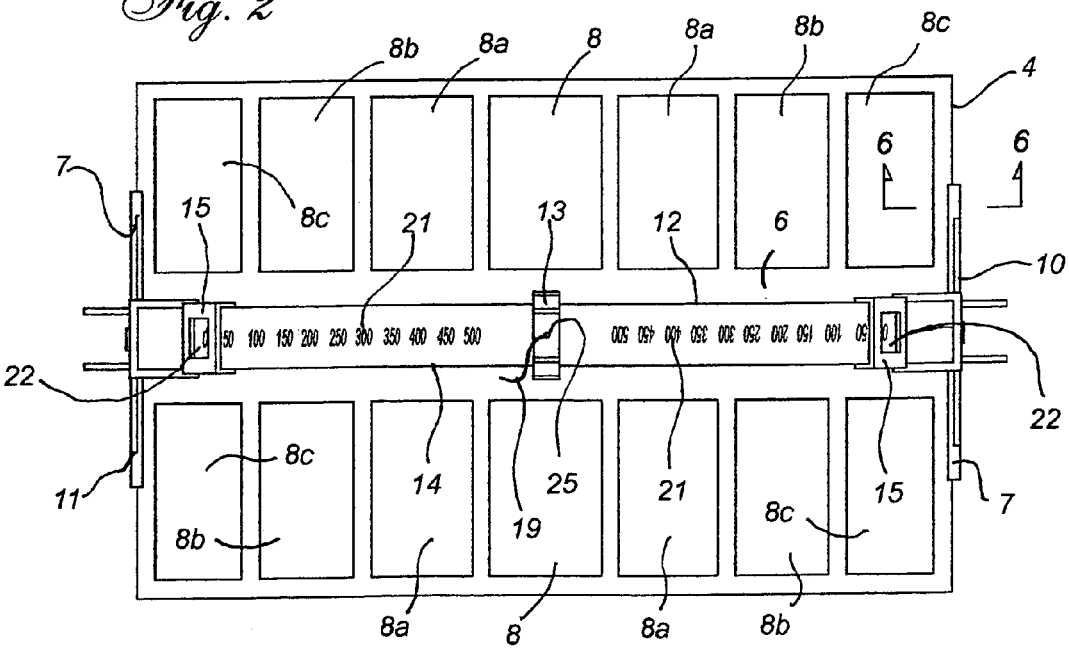
FIG. 2 is a top plan view of the game of hand-eye skill of the present invention.

Turning now to FIG. 2, a top plan view of the game of the present invention 2 particularly illustrating the plurality of cavities 8 formed in the liner tray 6. As a means of increasing the complexity level of the game, the value at the center cavities 8 is lowest while the value increases for each cavity 8*a,* 8*b* and 8*c* outward from the center cavity 8. For illustrative and exemplary purposes only, we can assign these cavities the following values: 8=25 points, 8*a*=50 points, 8*b*=75 points and 8*c*=100 points. Furthermore, this view illustrates the centered positioning of the arch members 12 & 14 atop the game box 4 as well as the centered positioning of the pivoting point of the suspended ball tether 19. Additionally, score markings 21 are permanently marked on the upper surface of each arch member 12 & 14. As a player scores, he would simply slide the score-keeping portion 15 to the appropriate marked numeral 21 on his respective arch 12 or 14.

Figure 3:
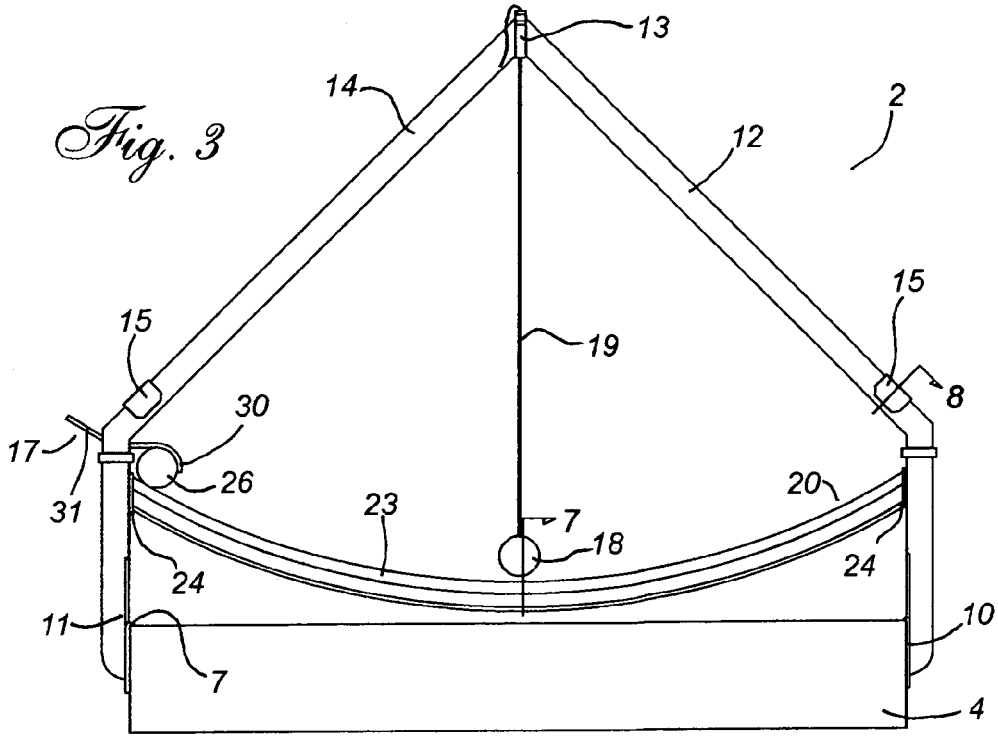
FIG. 3 is a front elevation view of the game of hand-eye skill of the present invention.

Turning to FIG. 3, a front elevation view of the game of the present invention illustrating the desired resting position of the tethered projectile 18 fixedly attached to a tether 19 and frictionally engaged between both upper ends of arches 12 & 14 which are releasably connected by means of an arch-connecting clip 13. The ball tether 19 can therefore be vertically adjusted by releasing the arch-connecting clip 13 thereby releasing the pressure normally applied between both arches 12 & 14 where the tether 19 traverses.

Figure 12:
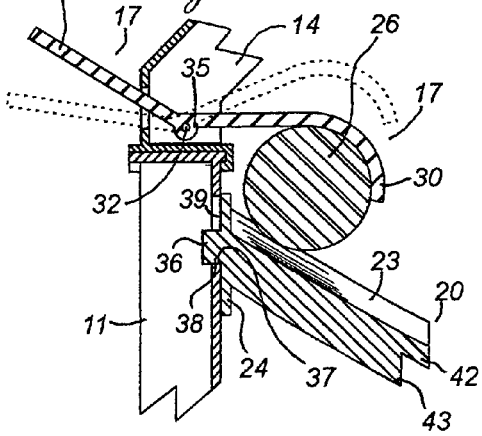
FIG. 12 is a cross-sectional view taken from FIG. 1 of the game of hand-eye skill of the present invention.

In reference now to both FIGS. 3 and 12, an accurate understanding of the free-ball releasing member 17 can be obtained where said member comprises: a free-ball retaining portion 30, a pivoting portion 32, and release lever 31 wherein the pivoting portion 32 is adapted with an axle 35 horizontally traversing through the pivoting portion 32 of the free-ball releasing member 17 and protruding outward from each side of said pivoting portion 32 into an indent within the inner wall surfaces of the arch member 14 thereby providing a fixed axis to the axle member 35 so as to allow pivotal movement of the free-ball releasing member 17.

Figure 4:
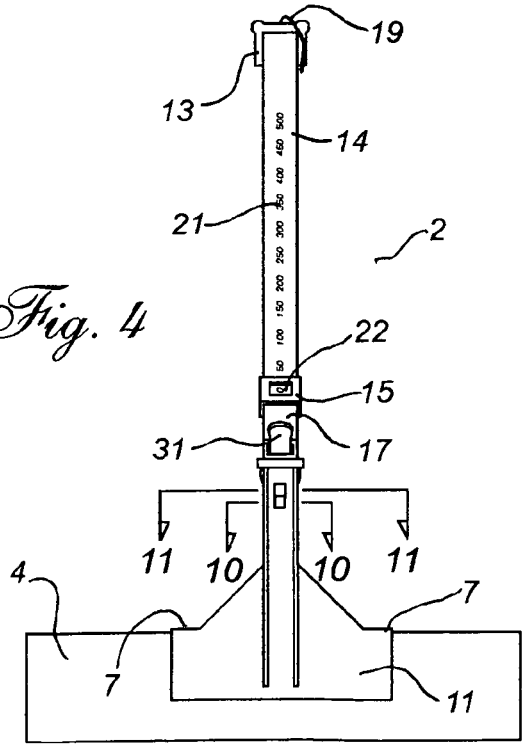
FIG. 4 is a left side elevation view of the game of hand-eye skill of the present invention.
Figure 5:
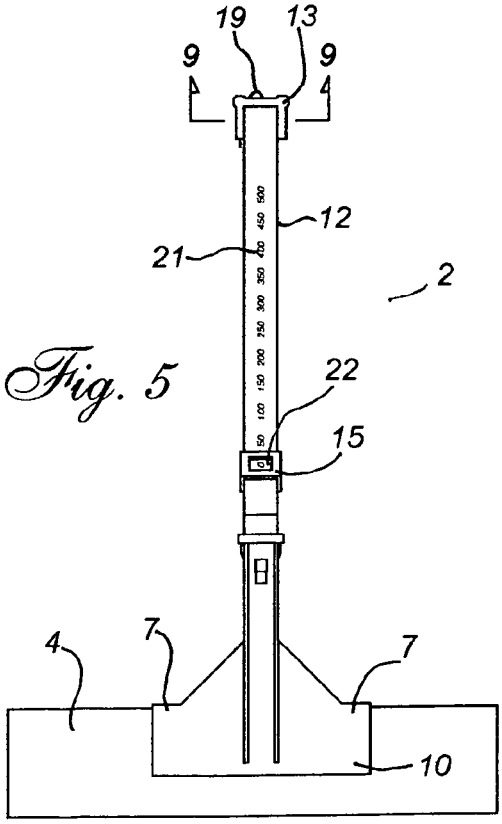
FIG. 5 is a right side elevation view of the game of hand-eye skill of the present invention.

Turning now to FIGS. 4 & 5, both illustrating side elevation views of the game of the present invention 2. In particular, FIG. 4 further illustrating a game box 4, an arch assembly 5 showing one game box-attaching portions 11, one upwardly and inwardly projecting arch members 14 and a scoring marker 15 frictionally and slidably engaged to the upper portion of the arch member 14, an arch-connecting clip 13, and a free-ball releasing member 17. It can be seen in this view that the curved rail is attached to the game box-attaching portion 11. Said attachment is further detailed in FIGS. 10, 11 & 12. Numeral markings 21 are permanently marked on the upper surface of each arch member 12 & 14 and the frictionally and slidably engaged scoring marker 15 is adapted with a viewing area 22 where the permanently marked scoring numerals 21 can be viewed.

Figure 6:
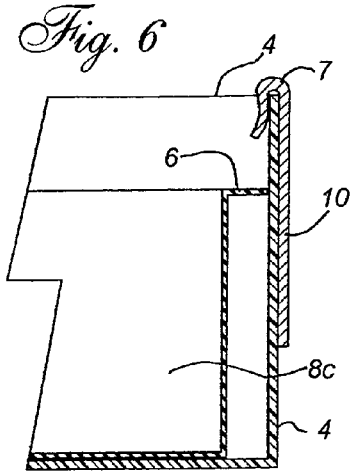
FIG. 6 is a cross-sectional view taken from FIG. 2 of the game of hand-eye skill of the present invention.

Turning to FIG. 6, a cross-sectional view taken from FIG. 2, illustrating the relational assembly of the liner tray 6 fitted to the inside of the game box 4. The liner tray 6 comprises a plurality of individual downwardly protruding cavities 8, 8*a–c* of various sizes located along both long edged of said tray 6. The lower portion of each cavity 8, 8*a–c* is in contact with the game box 4 floor so as to form a solid base on which the free target ball 26 ultimately falls. This figure also illustrates the connecting means between the raised edge of the game box 4 and the game box attaching portions 10 wherein the top of the box contacting portion of the game box-connecting member is adapted with an inwardly and downwardly hooked portion 7 having an inside dimension in the hook portion 7 lesser than the thickness of the game box wall thereby providing firm frictional attachment of the game box connecting member 10 to the game box 4. Although not illustrated, the above connection method applies to the opposing game box connector 11.

Figure 7:
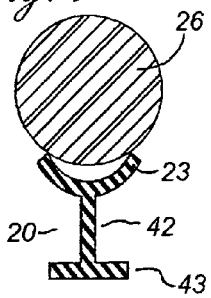
FIG. 7 is a cross-sectional view taken from FIG. 3 of the game of hand-eye skill of the present invention.

Referring now to FIG. 7, a cross-sectional view taken from FIG. 3, illustrating in detail, the profile of the curved free target ball rail having: a central member 42 providing vertical structural support to the rail, a lower member 43 perpendicularly and integrally attached to the central member 42, providing horizontal structural support to the rail, and a semi-circular upper rail portion 23 also integrally attached to the central member 42 and adapted with an inner radius lesser than that of the free target ball 26 so as to make as little contact with said ball in order to reduce friction.

Figure 8:
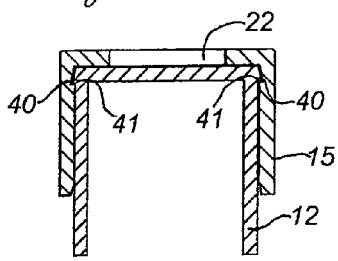
FIG. 8 is a cross-sectional view taken from FIG. 3 of the game of hand-eye skill of the present invention.

FIG. 8, also a cross-sectional view taken from FIG. 3, illustrates the details of the scoring marker 15 wherein each upper outside edges of the arch member 12 is provided with a raised profile 41 longitudinally with said arch member 12, and the upper inside edges of the scoring marker 15 is relationally indented 40. Therefore, the scoring marker 15 can slide longitudinally with the arch member 12 while ensuring it remains positively engaged to said arch member 12. It can also be noted that the scoring marker 15 is adapted with a viewing window 22 so as to allow the permanently marked numerals on the arch members 12 & 14 to be viewed.

Figure 9:
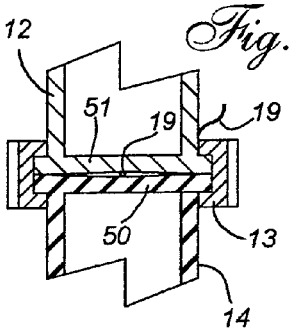
FIG. 9 is a cross-sectional view taken from FIG. 5 of the game of hand-eye skill of the present invention.

Turning to FIG. 9, a cross-sectional view taken from FIG. 5, illustrating the connection of both arch members 12 & 14 to each other wherein, each upper portion of each arch member 12 & 14 is adapted with a vertical planar end portion 50 or 51 integrally attached to its respective arch member 12 or 14 forming a generally mitered connection. Said vertical planar members 50 & 51 are of greater width when viewed from the end than that of its corresponding arch rail 12 or 14. There is provided, an arch-connecting clip 13 having a generally upside-down U-shaped body with a channel removed along all its inner edges so as to further form a C-shaped profile. Said channel is adapted be equal in inner width than the dimension of both vertical planar members 50 & 51 of the arch members 12 & 14 so as to be generally taut when the arch-connecting clip 13 is slidably engaged over the side edges of the vertical planar arch connecting members 50 & 51. Furthermore, when glancing at FIG. 2 once more, one can see that a perforation is provided through the top portion of the arch-connecting member 13. This perforation is provided to allow the tether 19 to pass through the clip 13 and between both vertical planar members 50 & 51 of the arch members 12 & 14. Therefore, while assembling the game 2, in particular the arch members 12 & 14, the tether 19 would first be threaded through the perforation 25 within the arch-connecting clip 13, the clip 13 and tethered ball assembly would be placed between the vertical planar members 50 & 51 and the arch members 12 & 14 would then be faced together with the tether 19 between both planar members 50 & 51, to complete the arch assembly and to adjust the tethered target-ball height, a player need only hold the tether at the correct height while slidably engaging the clip 13 to the planar members 50 & 51. The arch-connecting clip 13 would thereby "pinch" the tether 19 in a releasably secure position.

Figure 10:
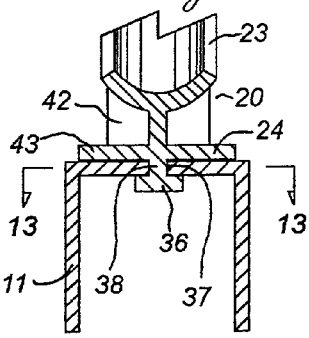
FIG. 10 is a cross-sectional view taken from FIG. 4 of the game of hand-eye skill of the present invention.
Figure 11:
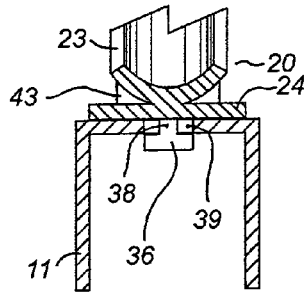
FIG. 11 is a cross-sectional view taken from FIG. 4 of the game of hand-eye skill of the present invention.
Figure 13:
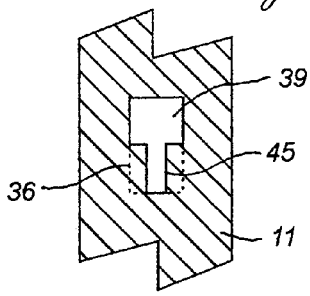
FIG. 13 is a cross-sectional view taken from FIG. 10 of the game of hand-eye skill of the present invention.

Turning now to FIGS. 10 & 11, both cross-sectional views taken from FIG. 4 where FIG. 10 illustrates the connection between the curved rail member 20 and the game box-connecting member 10 or 11. As further illustrated in FIG. 13, it can be seen that a latch 36 integrally formed in each end of the curved rail member 20 enters an opening 39 in the game box connecting member 10 or 11 having said opening 39 slightly larger than the integrally formed latch 36 in each end of the curved rail member 20. To lock the rail 20 with each game box connecting member 10 & 11, one pushes the rail downwardly so as to allow the narrow portion of the latch 38 to enter a similarly sized narrow channel 45 in the game box-connecting member 10 or 11 thereby disallowing the curved rail 20 to disconnect laterally unless a player intentionally disassembles the game 2.

What I claim as my invention:

1. A game of hand-eye skill comprising:

a. a game box having a generally rectangular plan and raised edges around its periphery, b. a liner tray fitted to the inside of the game box having a plurality of downwardly protruding cavities of various sized located along both long edges of said tray, c. an arch assembly having two game box attaching portions, two upwardly and inwardly projecting arch members, and vertical planar arch connecting members, d. score marking means frictionally and slidably engaged to the upper portions of each arch member, e. a free-ball curved rail member releasably and firmly attached to both game box attaching portion, f. an arch-connecting clip, g. a tethered projectile, h. a free-ball releasing means.

2. The game of hand-eye skill of claim 1, wherein the value at the center cavities is lowest while the value increases for each cavity outward from the tray liner's center cavities as a means of increasing the game's complexity level.

3. The game of hand-eye skill of claim 1, wherein each vertical planar arch-connecting member has a greater width when viewed from the end than that of its corresponding arch rail integrally attached to its respective arch member forming a generally mitered connection when both arch members are in a mirrored position to each other.

4. The game of hand-eye skill of claim 1, wherein the upper outside edges of the arch member is provided with a raised profile longitudinally with said arch member, and the upper inside edges of the scoring marker is relationally indented therefore, the scoring marker can slide longitudinally with the arch member while ensuring it remains positively engaged to said arch member, and said scoring marker is adapted with a viewing window through its upper portion so as to allow the permanently marker numerals on the arch members to be viewed.

5. The game of hand-eye skill of claim 1, wherein the free-ball curved rail further comprises a generally extruded profile having a vertical central narrow portion, a lower horizontally perpendicular portion integrally attached to the central portion, an upper upwardly curved rail portion also integrally attached to said central portion forming a generally I-beam profile where the upper portion of said I-beam is slightly curved upwardly, and two end connecting members adapted to relationally and releasably attached to each game box attaching portion.

6. The game of hand-eye skill of claim 1, wherein the arch-connecting clip further comprises a generally upside-down U-shaped body with a channel removed along all its inner edges so as to further form a C-shaped profile, and said channel is adapted be equal in inner width than the combined thickness of both vertical planar members of the arch members so as to be generally taut when the arch-connecting clip is slidably engaged over the side edges of the vertical planar arch connecting members.

7. The game of hand-eye skill of claim 1, wherein the tethered projectile further comprises a spherical projectile through which a bore is made at its center, a tether is knotted at one end then the opposing end is threaded through the projectile's bore so as to retain the projectile from further downward slippage, and the loose end of the tether is then frictionally and securedly attached between both vertical planar members of the arch members which are retained by the arch-connecting clip.

8. The game of hand-eye skill of claim 7 wherein the tether can be adjusted in height by means of disconnecting the arch connecting clip thereby loosening the tension between both arch members, at which time the loose end of the tether can be pulled or released according to the desired height of the projectile, once adjusted, the arch-connecting clip can be lowered over the vertical planar members of the arch members so as to secure the tether at this now desired length.

9. The game of hand-eye skill of claim 1, wherein the free-ball releasing means further comprises a free-ball retaining portion, a pivoting portion, and release lever wherein the pivoting portion is adapted with an axle horizontally traversing through the pivoting portion of the free-ball releasing means and protruding outward from each side of said pivoting portion into an indent within each inner wall surfaces of the arch member thereby providing a fixed axis to the axle member so as to allow pivotal movement of the free-ball releasing means.

* * * * *